United States Patent [19]

Kammann et al.

[11] 4,245,538

[45] Jan. 20, 1981

[54] PROCESS AND APPARATUS FOR CUTTING PORTIONS OUT OF A WEB OF MATERIAL

[75] Inventors: Knut Kammann, Bünde; Gerhard Tiemann, Löhne, both of Fed. Rep. of Germany

[73] Assignee: Werner Kammann Maschinenfabrik GmbH, Bünde, Fed. Rep. of Germany

[21] Appl. No.: 18,453

[22] Filed: Mar. 8, 1979

[30] Foreign Application Priority Data

Mar. 11, 1978 [DE] Fed. Rep. of Germany ..... 2810713

[51] Int. Cl.[3] ..... B26F 01/40

[52] U.S. Cl. ..... 83/880; 83/37; 83/284; 83/510; 83/318

[58] Field of Search ..... 83/879, 880, 37, 38, 83/284, 510, 511, 512, 318

[56] References Cited

FOREIGN PATENT DOCUMENTS 951062 3/1964 United Kingdom ..... 83/510

*Primary Examiner*—J. M. Meister

*Attorney, Agent, or Firm*—Howson and Howson

[57] ABSTRACT

In a process and apparatus for cutting portions such as labels or tickets from a continuously moving web, the web is passed between a blade and a co-operating support member. As the web moves past the blade, the blade is displaced during the cutting operation in the same direction as the web and synchronously therewith, but over a shorter distance than the length of the portion to be cut out. The blade is then disengaged from the web and returned to its initial starting position. The support member may also be displaced in the opposite direction to the movement of the web and blade during the cutting operation.

6 Claims, 18 Drawing Figures

13
16
15
18
17
25
63
4 3 2 1 0
81
68
83
R
X
A B C D
60
62
67
73
79
Y
Z 13
75
15
77
4 3 2 1 0
17
18
25
A B C D 13
62
63
77 60
69
4 3 2 1 0
18
15
17

13
77
15
4 3 2 1 0
18
73
17
25
68

FIG. 5
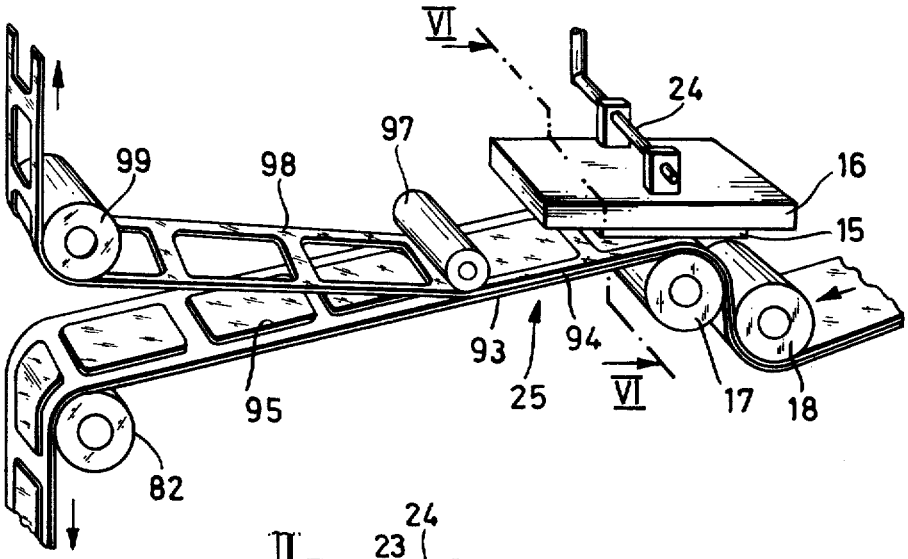
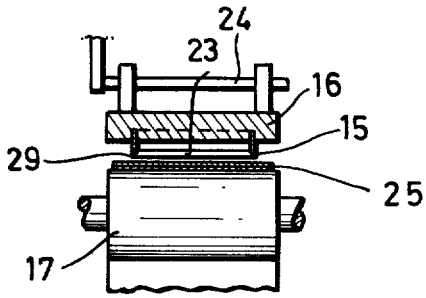
FIG. 6

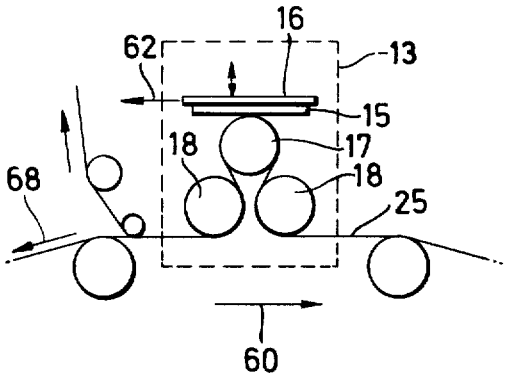
FIG. 7
FIG. 8
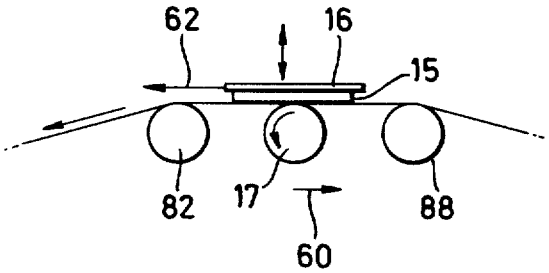
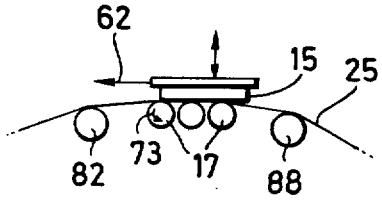
FIG.9

FIG. 10
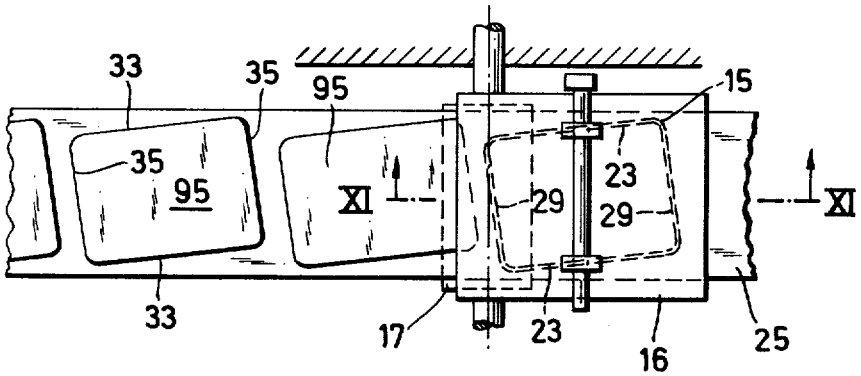
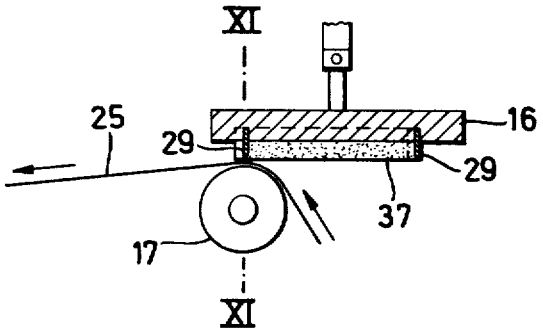
FIG. 11
FIG. 12
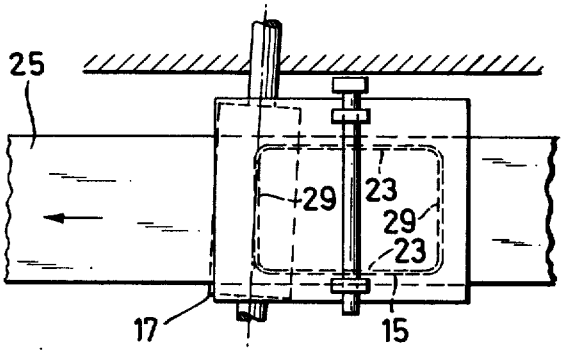

PROCESS AND APPARATUS FOR CUTTING PORTIONS OUT OF A WEB OF MATERIAL

BACKGROUND OF THE INVENTION

There is often a need to cut portions from a web of material, such as paper, for example for producing labels, adhesive stickers, tickets and the like, which web of material may have printing thereon, and may comprise two layers secured together by adhesive. The individual cut-out portions, which correspond for example to images or patterns printed on the web, may be punched or cut out of the web of material by cylindrical cutting or punching blades which rotate continuously, the web also moving uniformly in its longitudinal direction and passing over support or backing rollers to support the pressure of the blades on the web. The advantage of such cylindrical blades is that they have a high output capacity. However, they are relatively expensive to produce so that frequently they cannot be used for producing short runs of products, for cost reasons. Alternatively, the portions may be cut out by flat punching or cutting blades which can be relatively simple and therefore cheap to produce. However, these blades generally suffer from a low output capacity. Added to this is the fact that it is not possible for the individual cut-out portions to be stamped or punched out without a spacing between them when the web passes continuously through the blades.

SUMMARY OF THE INVENTION

An object of the invention is to provide a process and apparatus of the general kind briefly described above, whereby the cut-out portions can be stamped or punched out of a continuously moved web, with a high output capacity.

A further object is to provide such a process and apparatus which use punching or stamping tools which are cheap and easy to produce.

Another object of the invention is to provide such a process and apparatus which does not impose any restrictions of substance in regard to the size of the spacing between the individual portions, even though not using rotary blades, whereby the portions can be cut out from the web of material, with any desired spacing between the cut-out portions, without any such spacing or even with the cut-out portions overlapping.

Yet another object of the invention is to provide a stamping or punching tool which is cheap to produce and easily interchangeable so that the amount of time required for converting the machine, for example when changing over from one form of label to another, is small.

A still further object of the invention is to provide a process and apparatus which have all the possibilities which are found in the known processes and apparatus, in regard to the length and form of the cut-out portion produced.

According to the invention, in the cutting process the blade is first lowered on to the web. Then during the punching or stamping operation for cutting out the portion from the web, the blade is displaced, from its starting position into an end or limit position, in the direction of movement of the web, synchronously with the web, over a distance which is smaller than the length of the portion to be cut out, whereby the blade severs the portion. Thereupon the blade is lifted from the web and returned to its starting position.

This mode of operation provides that the speed at which the punching or stamping operation is carried out in the longitudinal direction of the web is greater than the speed of movement of the web so that, if such speeds are suitably selected and adapted to each other, it is possible for the distances between the individual cut-out portions to be varied, possibly down to zero, or even such that printed images or patterns on the cut-out portions overlap each other at their adjacent end regions. It is possible in this case to use a simple flat punch member which can be produced easily and inexpensively, even for cut-out portions which have a very irregular boundary.

In this process a support or backing member which is adapted to support the web against the blade may comprise at least one roller which is displaced in the opposite direction to the direction of movement of the web or blade, during the cutting operation. In this case, the lengths of the stroke movement and the speed of the blade and the support roller are added together. The amount of time required for carrying out the stamping or punching operation can additionally be further reduced if there are two or more support rollers which are arranged at a small spacing from each other, to co-operate with the blade. In this case, when the blade is lowered on to the rollers, the blade would first make a plurality of partial cuts in the web of material, which cuts would be then completed by the movement of the web and blade to form the finished cut-out portion.

This process can also be carried out using a plurality of support rollers which are disposed in a stationary arrangement but which are rotatable, as in the other above-mentioned modes of the process.

The web of material may be moved tangentially over the support roller or rollers. It is also possible however for the web to be passed around part of the periphery of a roller which serves as the support member, the web being rolled against the cutting blade during the cutting stroke movement of the blade. In this case, the process can be carried out in such a way that the section of web which passes into the stamping or punching mechanism, and the section of web which passes out of that mechanism, extend parallel to each other, at least in the region within which the support roller is moved during the cutting stroke movement; said sections of web preferably extend downwardly at an acute angle with respect to the substantially horizontally disposed blade. The cutting mechanism, which comprises the blade, the support roller and a web guide roller, may be moved, at least during the cutting stroke movement, parallel to the above-mentioned web sections. This manner of performing the process will be advantageous when the web is to be moved away from the generally flat cutting blade, at an acute angle, directly after the cutting operation, so that the blade and the web can be moved apart from each other as quickly as possible, thereby improving the quality of the cut and in particular ensuring that the cut-out portions have tidy cut edges. However, moving the section of web away from the cutting blade and the support roller in this way would result in a change in the speed of the web at the blade, particularly when the support roller is displaced in a horizontal plane during the cutting operation, so that the synchronisation between the movement of the blade on the one hand and the movement of the web on the other hand, which synchronisation is required for a good cut, would be lost. This is taken into account by the present invention, by the above-described mode of operation in which the movement of the support roller and thus the entire cutting mechanism is parallel to the path of movement of the web of material, being the path which the web follows between the guide elements which are generally in the form of rolls or rollers and which guide the web upstream and downstream of the cutting mechanism. The angle at which the two above-mentioned web sections extend is advantageously from 0° to 20° with respect to the horizontal (ie to horizontal cutting blade).

Irrespective of the manner in which the blade and the support member co-operate, it is always possible for the web to be divided into a plurality of individual cut-out portions, during the cutting stroke movement of the blade and/or support member. This operation depends only on the length of the stroke movement and the configuration of the cutting tool, so it is possible, for example, for three individual labels, which are disposed one after the other in the longitudinal direction of the web, to be cut out from the web in each cutting stroke movement; the three labels together form an overall cut-out portion, corresponding to that formed by the cutting stroke movement of the mechanism. In addition, two or more cut-out portions can be cut out from the web, one beside the other, that is to say, the two or more portions may be disposed side-by-side transversely relative to the longitudinal direction of the web. Here too, the determining factor involved is the dimensions of the cutting tool, although the width of the web must additionally be adapted to the number of individual portions which are to be cut out side-by-side.

The above-described process can be carried out by means of apparatus with a cutting or punching blade which can be raised and lowered, and a support or backing member disposed at the side of the web which is remote from the blade. The blade can be reciprocated with an adjustable stroke movement and the support member may also be arranged in such a way that it can be reciprocated with an adjustable stroke movement. However, the support member may comprise a plurality of rotary rollers which are disposed in a stationary arrangement, one beside the other, at small distances from each other, and the region within which the rollers are arranged may be at least as long as the dimension of at least one cut-out portion to be produced from the web. The support member may comprise at least one roller which is arranged so that it can be displaced in the opposite direction to the blade, during the cutting movement thereof, while in another embodiment, the support member may be of a plate-like configuration. In this construction the support member also corresponds in length to the dimensions of the at least one portion to be cut out, the support member being movable synchronously with the blade, at least during the cutting movement.

It will generally be desirable for the support roller and possibly also for one or more web guide rollers which may also be optionally provided, to be driven rollers, as otherwise the web of material would have to transmit the forces required to rotate such rollers. The support roller and/or the web guide roller or rollers may be driven, in their rotary movement, in dependence on the speed at which they are displaceable relative to the web during the cutting operation. An advantageous arrangement is one in which the apparatus has at least two drive or web guide rollers, each arranged at a spacing from the cutting tool, wherein gear wheels are fixed on each of the shafts which drive these rollers as well as the shafts for driving the support roller and web guide roller or rollers. The gear wheels are drivingly interconnected by way of a common flexible transmission means, for example a chain, which extends parallel to the web in the region in which the transmission means moves in the same direction as the web of material.

Another possible construction is for the rotary movement of the support roller during the cutting operation to be derived from the stroke movement of the cutting blade.

When cutting or stamping out square or rectangular cut-out portions, those parts of the blade which define the leading and trailing edges of the portion, with respect to the longitudinal movement of the web, extend perpendicularly to the web and parallel to the axis of the support roller, if the longitudinal axis of the cut-out portion extends parallel to the longitudinal axis of the web and the longitudinal axis of the support roller extends normal to the longitudinal axis of the web. A construction of this kind generally has the disadvantage that the whole length (which is transverse with respect to the web) of the parts of the blade which cut out the leading and trailing edges of the cut-out portion, passes simultaneously across the peripheral surface of the support roller, which results in a heavy loading on these parts of the blade. In addition, the quality of the severing cut at these positions may be reduced. It is therefore more desirable for the contact between the blade portions and the support roller to be more or less a point contact, as is the case with those parts of the blade which extend precisely or approximately parallel to the path of movement of the web. For this reason, the longitudinal axis of the or each support roller is preferably at an acute angle to a line which is parallel to the cutting blade and perpendicular to the direction of movement of the web. The acute angle may be for example from 5° to 10°. Another possible arrangement is for the longitudinal axis of the cut-out portion formed by the blade to be at an acute angle to the longitudinal axis of the web; that is to say, the blade is turned somewhat relative to the web, an angle of 5° or 10° being sufficient to achieve the desired effect.

A central drive means may be provided for all the movable components of the apparatus. The speed of movement of the web may be adapted to the speed of the blade by an adjustable transmission means which is connected into the transmission of drive to the web. In addition, it is also possible for the means for transmitting the drive to the holder for the blade and/or to the holder for the support member, and possibly any guide rollers which may be provided, to be adjustable and/or interchangeable, to provide for variations in the speed and/or stroke length of the components.

It is readily possible for a process and apparatus according to the invention to be combined with a process and apparatus for applying printed images or patterns to a web, for example in such a way that one or more apparatuses for printing on the web are disposed upstream and/or downstream of the cutting apparatus according to the invention, the web being passed through all the apparatuses in a working operation. In this case also, a common central drive means may be associated with all the apparatuses.

BRIEF DESCRIPTION OF THE DRAWINGS

FIG. 5 shows a perspective view of a punching or stamping apparatus for cutting out portions from a web, FIG. 6 shows a view of the FIG. 5 apparatus in section taken along line VI—VI in FIG. 5, FIG. 7 shows a diagrammatic side view of a second embodiment of a stamping or punching mechanism, FIG. 8 shows a diagrammatic side view of a third embodiment of a punching or stamping tool, FIG. 9 shows a diagrammatic view of a fourth embodiment of a punching or stamping tool, FIG. 10 shows a diagrammatic plan view of a punching or stamping tool, with associated web, FIG. 11 shows a view taken in section along line XI—XI in FIG. 10, FIG. 12 shows a view corresponding to FIG. 11 of another possible embodiment.

DESCRIPTION OF THE PREFERRED EMBODIMENTS

Figure 1:
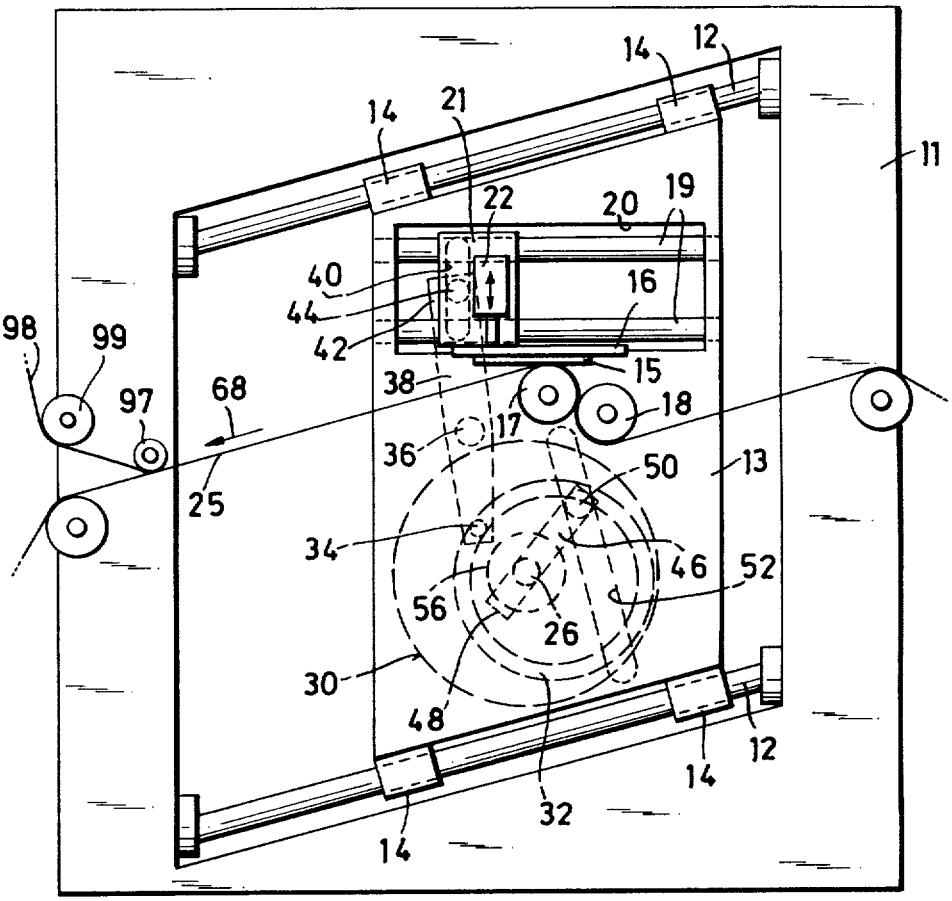
FIG. 1 shows a front view of a stamping or punching apparatus for cutting portions from material in web form.

A process and apparatus for severing individual portions such as tickets or labels from a web of material, by means of a punching or stamping cutting operation, will firstly be described hereinafter with reference to the embodiment shown in FIGS. 1 through 6.

Operation is normally such that a web 25 of material, comprising two layers 93 and 94 secured together by means of adhesive, is firstly printed on one side. Thereafter, the individual labels or tickets are cut out, by means of a suitable tool, from that one of the two layers 93 and 94 which carries the printed image or pattern. The tickets or labels 95 which are cut out in this way initially remain on the layer 93 which serves as a carrier web, and are subsequently removed from the carrier layer 93 in the usual manner. The remaining strip which results after the labels 95 have been cut out and after the two layers 93 and 94 have been moved apart from each other is discharged in any suitable manner.

The individual tickets or labels 95 are separated out from the layer 94 by means of a stamping or punching blade 15 which is carried by a holder 16. The configuration of the cutting edges 23 and 29 of the blade 15 corresponds to the desired configuration of the finished label or ticket. The blade 15 co-operates with a support or backing abutment roller 17 with which there is associated a direction-changing or guide roller 18. The support roller 17 and the roller 18 are carried by a carriage 13 (see FIGS. 1 and 2 and also FIGS. 4*a* through 4*f*) which is guided for reciprocating movement on two beam or guide members 12 which extend at an angle of about 15° relative to the horizontal. The beam members 12 are secured to the frame of the punching or stamping apparatus. The carriage 13 is provided with eyes, lugs or the like, as shown at 14, which embrace around the members 12.

The first carriage 13 is provided with two horizontal guide beam members 19 which are arranged within a recess or opening 20 in the first carriage 13. It will be appreciated that, as also in the case of the carriage 13, other guide means and arrangements thereof are also possible. A second carriage 21 is reciprocably guided on two beam members 19. The carriage 21 carries the mounting 16 for the punching or stamping blade 15, by way of an interposed fluid-operated piston-cylinder unit 22. The arrangement is such that there is provided a carrier member 24 on which the holder 16 is mounted for vertical adjustment.

The roller 17 which serves as a support or abutment roller is disposed directly below the blade 15 which, in its bottom limit position, cuts into the upper layer 94 of the web 25, in the region of the highest point of the roller 17.

The drive for the punching or stamping apparatus is derived from a main drive shaft 26 (see FIGS. 1 and 2) which is driven by way of a transmission assembly 27 by a motor 28. Secured to the shaft 26 is a disc or wheel 30 which, at its side face which is towards the motor, provides a cam surface 32. A cam follower as indicated at 34, for example a roller, cam lever or the like, co-operates with the cam surface 32. The cam follower 34 is mounted at one end of a double-arm lever 38 which is mounted in the frame 11 at pivot 36. The second carriage 21 is provided with a vertical slot 40 into which there engages a cam follower 44, for example in the form of a roller or the like, which is carried by the second arm 42 of the lever 38. Thus, pivotal movement of the lever 38, caused by the cam surface 32, results in a reciprocating movement of the carriage 21. The configuration of the cam surface 32 is such that the carriage 21 and thus the blade 15 are moved at a constant speed during the punching or stamping operation for cutting out the individual label or ticket, assuming that the speed at which the web 25 is moved is suitably adapted to that of the blade 15 during the cutting or stamping stroke movement of the assembly. For the purposes of adapting the assembly to different lengths of portion to be cut or stamped out of the web 25, the cam follower 44 at the second end 42 of the second arm of the lever 38 is mounted so as to be adjustable thereon in the longitudinal direction. The stroke length and the speed of the carriage 21 and thus the blade 15 are increased as the cam follower 44 is moved increasingly further away from the pivot mounting 36. Increasing the length of the stroke movement in this way can also increase the length of the cut-out portion which is to be cut out from the web 25 in the longitudinal direction thereof, in the course of a stroke movement of the punching or stamping assembly.

The first carriage 13 is driven in its reciprocating motion along the beam members 12 by way of an adjustable crank line or arm 46 which is pivoted to the disc or wheel 30, at the side thereof which is opposite the cam surface 32, by means of pivot mounting 48. At its free end, the arm 46 carries a cam follower 50 such as a roller or the like, which engages into an elongate opening or slot 52 in the carriage 13. As shown in FIG. 1, the slot 52 extends perpendicularly to the beam members 12 and thus perpendicularly to the line of movement of the carriage 13 as it reciprocates along the beam members 12. It will be appreciated that the effective length of the arm 46, between its pivot mounting 48 and the cam follower 50, is adjustable, by corresponding adjustment of the pivot mounting 48 on the wheel 50 which is continuously rotatable by the drive shaft 26.

Also secured to the drive shaft 26 is a gear wheel 56 which is connected by way of a suitable transmission member such as a chain 57 or the like, to a drive or input gear wheel 58 of a variable transmission assembly 59. The output shaft 64 of the transmission assembly 59 is connected by way of a gear wheel 65, transmission members such as chains or the like, as at 66, 68 and 70, and gear wheels 72, 74 and 76 co-operating therewith, firstly to a supply roll 7 from which the web 25 to be processed is wound off, secondly to a roll 80 on which the carrier web 93 with the labels or tickets 95 adherring thereto is wound, and thirdly to a drive roller 82 by means of which the carrier web 93 and thus the web 25 are drawn out of the punching or stamping tool. The remaining web section 98 which remains after the labels or tickets 95 have been cut out of the layer 94 is passed over a roller 99 which may possibly also be driven, by way of suitable transmission means, for example by the shaft 84. The carrier web 93 and the remaining web section 98 are separated from each other by pulling the remaining web section 98 from the layer 93 and the labels or tickets 95 disposed thereon. A roller 97 is provided for determining the region in which the web 93 and the web section 98 are separated from each other.

A further gear wheel (not referenced) is fixedly mounted on the shaft 84 on which the roller 82 and the gear wheel 76 are secured. The further gear wheel is connected by way of a flexible transmission member 86, for example a chain, to gear wheels 85, 87 and 89, for driving same. The gear wheels 87 and 98 are fixedly connected to the shafts which carry the abutment or support roller 17 and the web guide roller 18 respectively. The gear wheel 85 is fixedly connected to a shaft which carries a drive roller 88 so that the chain 86 or like transmission member drives the drive roller 88, the abutment or support roller 17 and the web guide roller 18. It will be seen that relative reciprocating movement of the two rollers 17 and 18 in the directions indicated by arrows 67 and 69 respectively will positively result in the peripheral speed of the two rollers 17 and 18 being adapted to the relative speed at which the web 25 moves over the peripheral surfaces of the two rollers 17 and 18, when the rollers 17 and 18 are reciprocated. Normally, the arrangement will be such that a slipping clutch (not shown) is arranged between the respective gear wheels 72 and 74 on the one hand and each of the two rolls 78 and 80 on the other hand, as variations in the peripheral speeds of the rolls 78 and 80, which variations occur in the course of the operation of winding on or winding off the web 25, will make it impossible for the web to be precisely adjusted to its desired speed, by the drive means associated with the two rolls 78 and 80. The speed of the web 25 between the two rolls 78 and 80, which must be adapted to the speed at which the blade 15 is moved during the punching or stamping stroke movement, is determined by means of the rollers 17, 18, 82 and 88.

Figure 3:
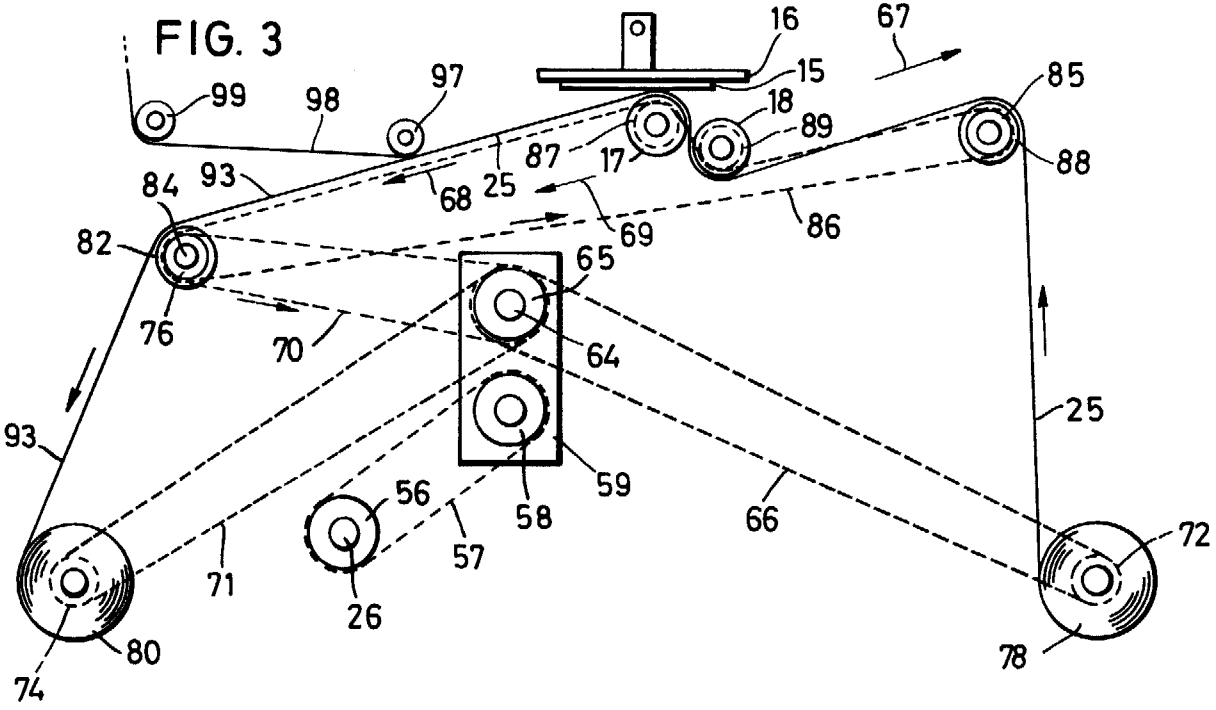
FIG. 3 shows a diagrammatic view of transmission means for transmitting the drive for the punching or stamping tool and the web.

It will be noted from FIG. 3 that the chain 86 is parallel to the web 25, at least in its portion, adjacent the movement-indicating arrow 68, which moves in the same direction as the web 25. It will also be seen that the portion of the web 25 which passes into the punching or stamping mechanism (comprising rollers 17 and 18 and blade 15) is at least substantially parallel to the portion of the web which leaves the punching or stamping mechanism, which two web portions are disposed at an acute angle, for example from 0° to 20°, relative to the horizontal, or relative to the horizontally disposed blade 15.

Figure 2:
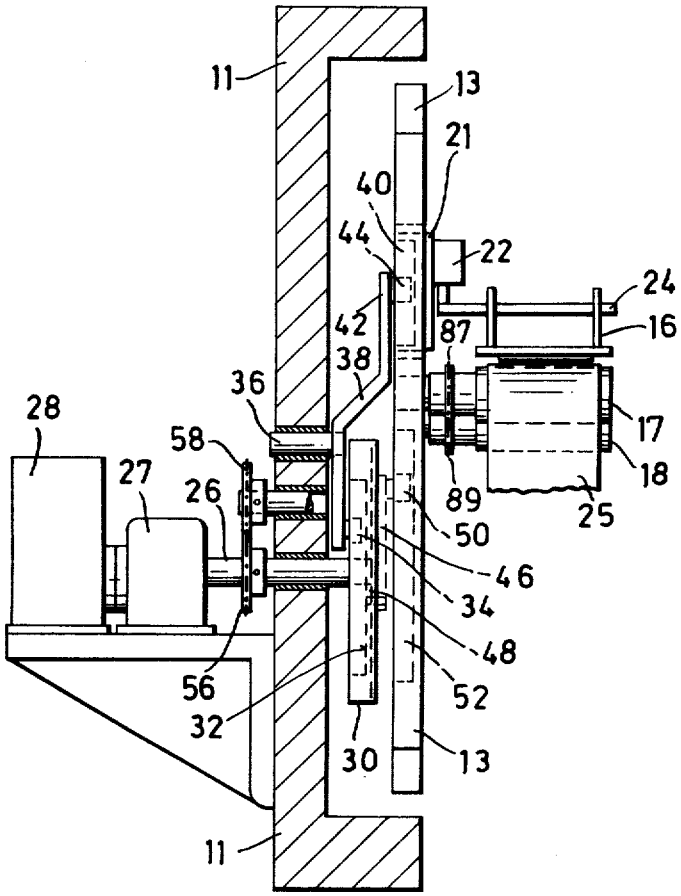
FIG. 2 shows a side view of the apparatus of FIG. 1.

FIGS. 1 and 2 do not show the drive and transmission means of FIG. 3, except for the gear wheels 56 and 58, for the sake of clarity of the drawing.

FIGS. 4*a* through 4*f* show a diagrammatic view of the successive stages in the punching or stamping operation, during a working cycle of the apparatus. FIGS. 4*a* through 4*f* only show the components which form part of the punching or stamping mechanism for cutting out the portions from the web, that is to say, the holder 16 with the blade 15, the abutment or support roller 17 and the web guide roller 18, and also the first carriage 13 and the web 25. FIGS. 4*a* through 4*f* also show equally spaced reference lines A through D, in association with the punching or stamping tool, whose purpose is to indicate the extent of the movements of the various components of the mechanism, that is to say, carriage 13 with rollers 17 and 18 on the one hand, and the holder 16 with blade 15 on the other hand. The web 25 leaving the roller 17 has associated therewith a reference scale 63 in order clearly to show the movement of the web 25.

In the following description, it is assumed that the cut-out portions, for example tickets, labels or the like, are formed on the web 25 without any spacings therebetween. In this respect, as has already been referred to above, a said cut-out portion is considered to be that part of the web 25 (or the layer severed by the blade 15), which is cut out of the web or layer in one working operation, that is to say, in the course of a stroke movement of the blade 15. As mentioned above, the cut-out portion may be divided into a number of individual portions such as individual tickets or labels, so that the possibility that the cut-out portion may be simultaneously divided into individual parts simultaneously in the longitudinal direction of the web and/or transversely with respect to the longitudinal direction of the web, remains unaffected.

Figures 4A, 4B, 4C:
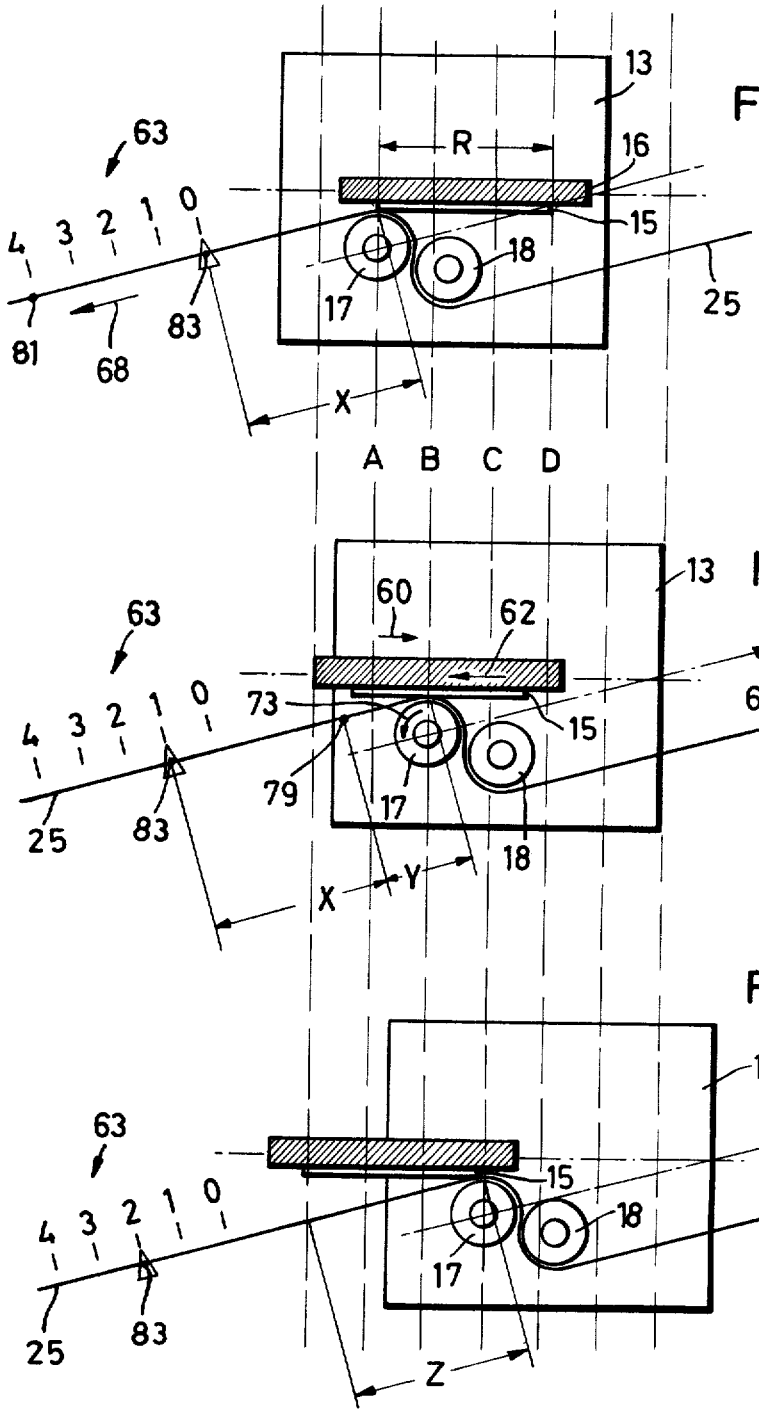
FIGS. 4*a* through 4*f* show successive stages in an operating cycle of the apparatus.

FIG. 4*a* shows the position of the components at the beginning of the working cycle. The blade 15 has been lowered on to the web 25 in the region of the highest point of the support or abutment roller 17. The carriage 13 with roller 17 and web guide roller 18 is in the leftward limit position. In the course of the subsequent punching or stamping stroke movement, the carriage 13 is moved generally towards the right as indicated by arrow 67 and the holder 16 with blade 15 is simultaneously moved towards the left as indicated by arrow 62; the two movements are superimposed, in respect to the blade 15, as the blade is mounted on the carriage 13 by way of the second carriage 21.

The length of a cut-out portion, as viewed in the longitudinal direction of the web 25, is to correspond to the length of the scale 63 (in sections 0–4). The limits or ends of the cut-out portion which has cut out in the next-but-one operating cycle before that which will begin with the position shown in FIG. 4*a*, are denoted by points 81 and 83. The cut-out portion which was cut out in the working cycle directly preceding that which will begin with the position of FIG. 4*a* lies in the region between point 83 and the highest point of the roller 17, and corresponds to the distance X in FIG. 4*a*. In the course of the punching or stamping stroke movement, the roller 17 and the web guide roller 18 on the one hand, and the blade 15 on the other hand, are moved in opposite directions, and the part of the web 25 around a part of the periphery of the roller 17 is rolled against the blade 15. Because of these relative opposed movements of the components forming the stamping or punching mechanism, as indicated by arrows 60 and 62, in particular the movement of the roller 17 in the opposite direction to the direction of movement of the web 25, they provide that the blade 15 and the roller 17 are moved relatively to each other in opposite directions over a distance R which corresponds to the length of the cut-out portion, or the distance 0–4 on the scale 63 before the web 25 has been fed forward by approximately half the length of the cut-out portion to be severed. This can be clearly seen from a comparison between FIGS. 4*a* and 4*b*. In the course of the first phase of the punching or stamping operation, the roller 17 has moved from the starting position A in FIG. 4*a* to an intermediate position B in FIG. 4*b*, the two components 17 and 15 having moved in the opposite direction to the direction of movement 68 (FIG. 4*a*) of the web 25. At the same time, the blade 15 is moved in the opposite direction (towards the left in FIG. 4*a*) by a distance which approximately corresponds to half its total length of movement, so that the longitudinally extending portion X of web 25, which is cut out of the web in the course of this working phase and which lies between the point 79 which was disposed at the highest point of the roller 17 in the starting position shown in FIG. 4*a*, and the point on the web which now lies at the highest point of the roller 17, that is to say, in the position of the components shown in FIG. 4*b*, is greater than the distance by which the web 25 was moved forwardly in the direction of the arrow 68, during this working phase. This can be seen from the distance covered by the point 83 on the web 25, as indicated by the triangular marking, from the FIG. 4*a* position to the FIG. 4*b* position. It will be appreciated that this mode of operation is based on the fact that, because the support or abutment roller 17 moves in the opposite direction to the movement 68 of the web 25, the blade 15 moves in the direction 68 only over a distance which is less than the length of the cut-out portion, during the stamping or punching operation. The length of the portion X which extends in the longitudinal direction of the web 25 and which is cut out during approximately the first half of the punching or stamping stroke movement is approximately twice the length of the section 0–1 on the scale 63, the section 0–1 being the distance by which the web 25 has been fed forward in the same period of time.

FIG. 4*c* shows the position of the mechanism at the end of the cutting stroke movement. The roller 17 and the blade 15 have each been advanced further forward by about a distance which corresponds to the distance between the working positions shown in FIGS. 4*a* and 4*b*. The roller 17 which rotates in the direction indicated by arrow 73 during the cutting operation is disposed at line C. The blade 15 has assumed its left-hand limit position. The length of web 25 which is cut out during this cutting operation is indicated by Z and corresponds to distance 0–4 on the scale 63. In contrast, during this whole cutting stroke movement, the web 25 has been moved forward in the direction indicated by arrow 68 only by a distance such that the point 83 (indicated by the triangle) is now located at marking 2 on the scale 63.

Figures 4D, 4E, 4F:
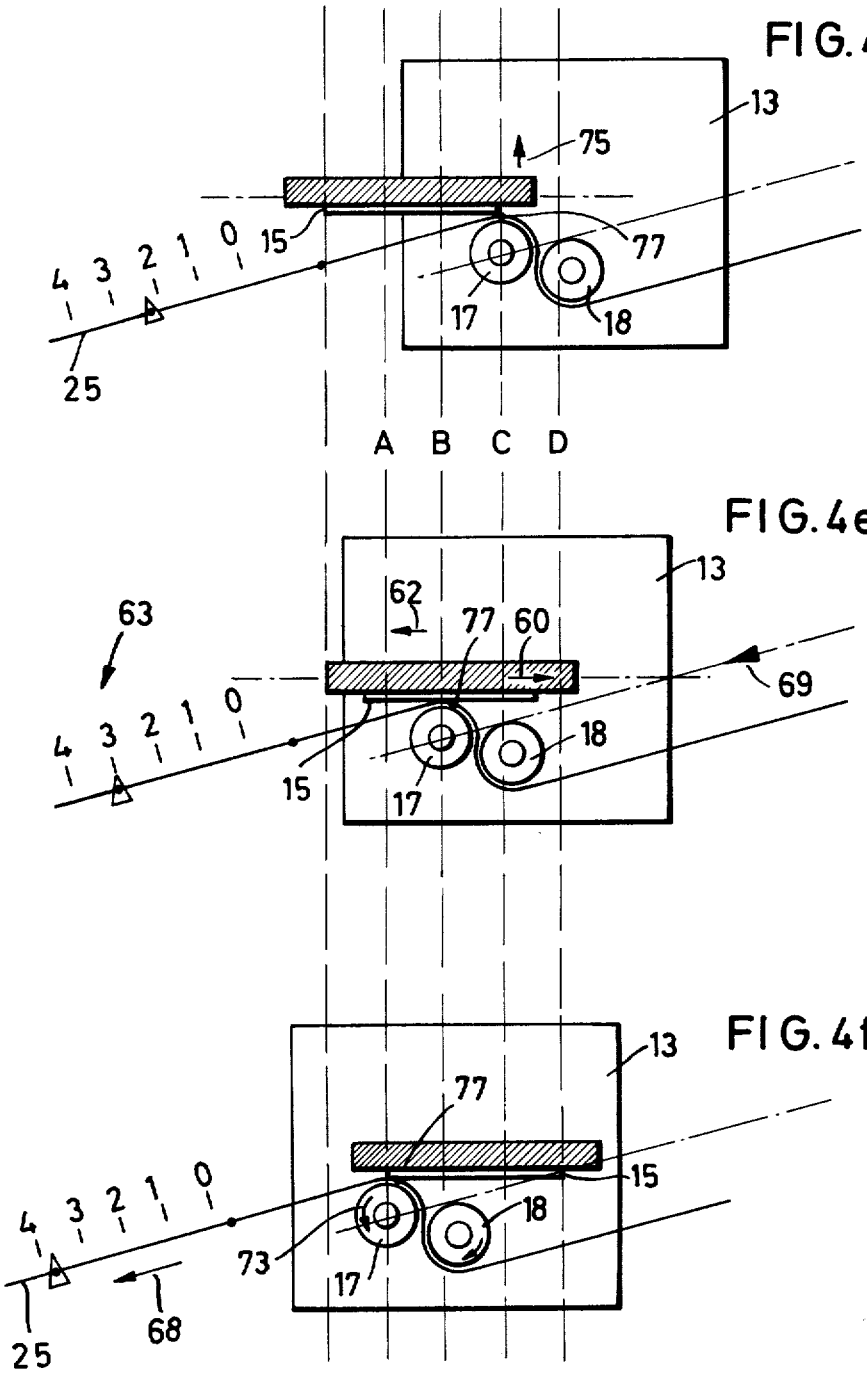

FIG. 4*d* shows the components of the mechanism in the position corresponding to FIG. 4*c*, except that the blade 15 has now been lifted from the web 25, in the direction indicated by arrow 75. Then, the carriage 13 is returned by movement in the direction indicated by arrow 69. At the same time, there is a return movement of the carriage 21 relative to the carriage 13. FIG. 4*e* shows an intermediate position in the course of these movements of the co-operating components of the cutting mechanism, such movements being in the opposite direction to the corresponding movements in the cutting process. The speed at which the carriage 13 is moved back to its starting position in the direction indicated by arrow 69 is greater than the speed of the web 25, when the cut-out portions to be cut from the web do not have any spacing therebetween. The resulting overtaking effect of the roller 17 has the result that, when the components have reached the position shown in FIG. 4*f* at the end of the return movement, the end of the cut-out portion which was previously cut out of the web and which is indicated by point 77 in FIGS. 4*d* through 4*f*, this being the end which is towards the cutting mechanism, is at a position which is just shortly upstream of the highest point of the roller 17, as viewed in the direction of rotation 73 of the roller 17. The period of time which is required for the web 25 to be moved forward such an extent that the point 77 is at the highest point of the roller 17 is used for lowering the blade 15 on to the web 25.

The length and speed of the stroke movements which are performed by the two carriages 13 and 21 depend on the adjustment of the two cam followers 44 and 50 relative to the associated slots 40 and 52. The length of the stroke movements which are performed during the stamping or punching operation by the blade 15 and the roller 17 determines the length of the resulting overall stroke movement R (see FIG. 4*a*) and thus the lengthwise dimension of the cut-out portion. It follows from this that, when the length of the cut-out portion is changed, at least the length of the stroke movement of the blade 15 or the carriage 21 must be accordingly adjusted, which in turn results in a change in the speed of the blade during the stamping or punching operation. As the web 25 is rolled against the blade 15 during the cutting operation, the speed of the web must thus also be adjusted to that of the blade 15. This is advantageously effected by suitable adjustment of the variable transmission assembly 59 whose drive wheel 58 is driven at a constant speed but whose output shaft 64 rotates at a speed dependent on the respective selected setting of the transmission assembly. Another possibility of adjustment in this manner is for the cam surface 32 or the wheel 30 which carries the cam surface 32, to be replaced, and thus for the drive conditions of the blade 15 and possibly the rollers 17 and 18, to be altered. It will be appreciated that both these possible means of adjustment may be used in combination.

It will be appreciated that modifications may be made in respect to the movements and operations described hereinbefore with reference to FIGS. 4*a* through 4*f*, for example such that, at the end of the cutting stroke movement, in which the components of the cutting mechanism are in the position shown in FIG. 4*c*, the point 83 on the web 25 has still not reached the marking 2 on the scale, or possibly has already passed beyond that marking. In the ultimate analysis, the determining factors are the periods of time required for the individual working steps and the speed at which the working steps are to be performed. Thus it is also possible for the process to be carried out in such a way that the successive cut-out portions overlap each other at their end regions. For this purpose it would only be necessary for the cutting mechanism to be returned to its FIG. 4*f* position so rapidly or so early that the next cutting operation begins before the end point 77 of the cut-out portion which was cut out in the preceding cycle has reached the highest point of the roller 17. It will be seen in particular from this example that the cutting operation according to the invention is not only simple but also of extraordinary versatility and highly flexible.

This also applies in respect of the embodiments shown in FIGS. 7 to 10 which differ from that shown in FIGS. 1 through 6, essentially by virtue of the configuration and/or the movement of the support or abutment member.

In the embodiment shown in FIG. 7, two web guide rollers 18 are associated with the abutment or support roller 17. One of the rollers 18 is arranged upstream of the roller 17, while the other is arranged downstream thereof, as viewed in the direction of movement 68 of the web 25. All the rollers 17 and 18 are carried by the carriage 13. The reciprocating movements of the rollers 17 and 18 on the one hand and the holder 16 with the blade 15 on the other hand are in the direction indicated by arrows 60 and 62, that is to say, in a horizontal plane. The holder 16 is arranged so that it can be moved up and down, in the usual manner.

In the embodiment shown in FIG. 8, the support or abutment member is also in the form of a roller 17. The movements of the blade 15 and the roller 17 correspond to those of the embodiment of FIG. 7, that is to say, both components are reciprocal in the direction indicated by arrows 60 and 62, in the region between the drive or web guide rollers 82 and 88.

In the embodiment shown in FIG. 9, the support or abutment member comprises three support or abutment rollers which are arranged one beside the other in a plane in the longitudinal direction of the web 25. The rollers 17 are rotatable at least in the direction indicated by arrow 73, but, in contrast to the other embodiments described above, they are disposed in a stationary arrangement between the rollers 82 and 88. The blade 15 is arranged so that it can be reciprocated in the usual manner in the direction indicated by arrow 62 during the cutting operation and in the opposite direction in the return movement. The length of the region in the direction 62 of the blade 15, in which the parallel rollers are disposed, is slightly greater than the length of the greatest cut-out portion which is to be cut out of the web, using this mechanism. The distances between the rollers 17 may be increased, in proportion as the length of the stroke movement of the blade 15 is increased. In practice, the distance between the rollers and thus the number thereof, are so selected that the distance over which the blade 15 is moved synchronously with the web 25 is sufficiently short for the blade 15 to be returned to its starting position again sufficiently early. The arrangement may also be such that the blade 15 is formed by three blade portions which are arranged one behind the other in the longitudinal direction of the web 25; each of the three blade portions severes a respective part of the cut-out portion, from the web 25. One of the rollers 17 may be associated with each of the above-mentioned blade portions. The blade portions can be easily formed by providing two further transversely extending cutting edges between the two ends of the blade 15, at a spacing therefrom and from each other.

It is obviously also possible to use two or more than four abutment or support rollers. Generally, as the number of rollers increases, the length of the stroke movement to be performed thereby can be made smaller, until it can possibly be reduced to zero.

FIGS. 10 to 12 of the drawings show the configuration of the cutting edges of the blade 15, for stamping or punching out a cut-out portion of rectangular or generally square shape. The two cutting edge portions 23 represent the longitudinal boundary lines of the portion 95, whereas the leading and trailing cutting edge portions 29 form the severing cuts at the front and rear boundary lines 35 of the portion 95. In the construction shown in FIGS. 10 and 11, the blade 15 is so arranged on the holder 16 that the longitudinal axis of the blade, and thus also the longitudinal axis of each cut-out portion 95, forms an acute angle to the longitudinal axis of the web 25. It can be seen particularly clearly from FIG. 10 that, by virtue of this arrangement which results in the leading and trailing cutting edge portions 29 being set in a corresponding inclined position relative to the longitudinal axis of the abutment or support roller 17, linear contact between the web 25 and the cutting edge portions 29 in the region of the highest point of the roller 17, over the entire length of the cutting edge portions, is avoided. On the contrary, the cutting edge portions come into contact with the roller with a point contact or at any event over only a short line distance, which assists in carefully treating the blade 15, in particular the cutting edge portions 29.

FIG. 11 shows that an insert 37 of foam rubber or similar material which is easily elastically deformable is arranged within the space defined by the cutting edge portions 23 and 29. The height of this insert approximately corresponds to the height by which the blade 15 projects relative to the holder 16. The foam rubber insert is somewhat compressed during the cutting operation, between the holder 16 and the roller 17 or web 25. As soon as the foam rubber insert 37 has moved beyond the support or abutment roller 17, it resumes its original shape, by increasing its volume, the web 25 being pressed down by the blade 15.

FIG. 12 shows another embodiment which also serves to ensure that the leading and trailing cutting edge portions 29 of the blade 15 move over the roller 17 at an acute angle thereto. For this purpose, the roller is arranged in such a way that it is somewhat pivoted from the normal position in which it is perpendicular to the longitudinal axis of the web 25, in such a way that the longitudinal axis of the roller 17 is at an angle of a few degrees, for example from 5° to 10°, to the projection of the longitudinal axis of the web 25. In this case, the cutting members 29 and 23 which define the blade 25 may extend perpendicular or parallel to the longitudinal movement of the web 25, with the result that there is a smaller amount of wastage. In particular, it is possible for the entire width of the web to be utilised if required. FIG. 12 shows that, with this kind of construction, the web 25 does not move precisely perpendicularly with respect to the roller 17. However, this is of no importance at any event when the web 25 only moves tangentially past the roller 17, that is to say, this kind of arrangement of the support or abutment roller or rollers 17 can be used in the constructions shown in FIGS. 8 and 9, whereas the arrangement of FIGS. 10 and 11 will be more desirably used in the constructions shown in FIGS. 1 through 6 and 7.

Figure 13:
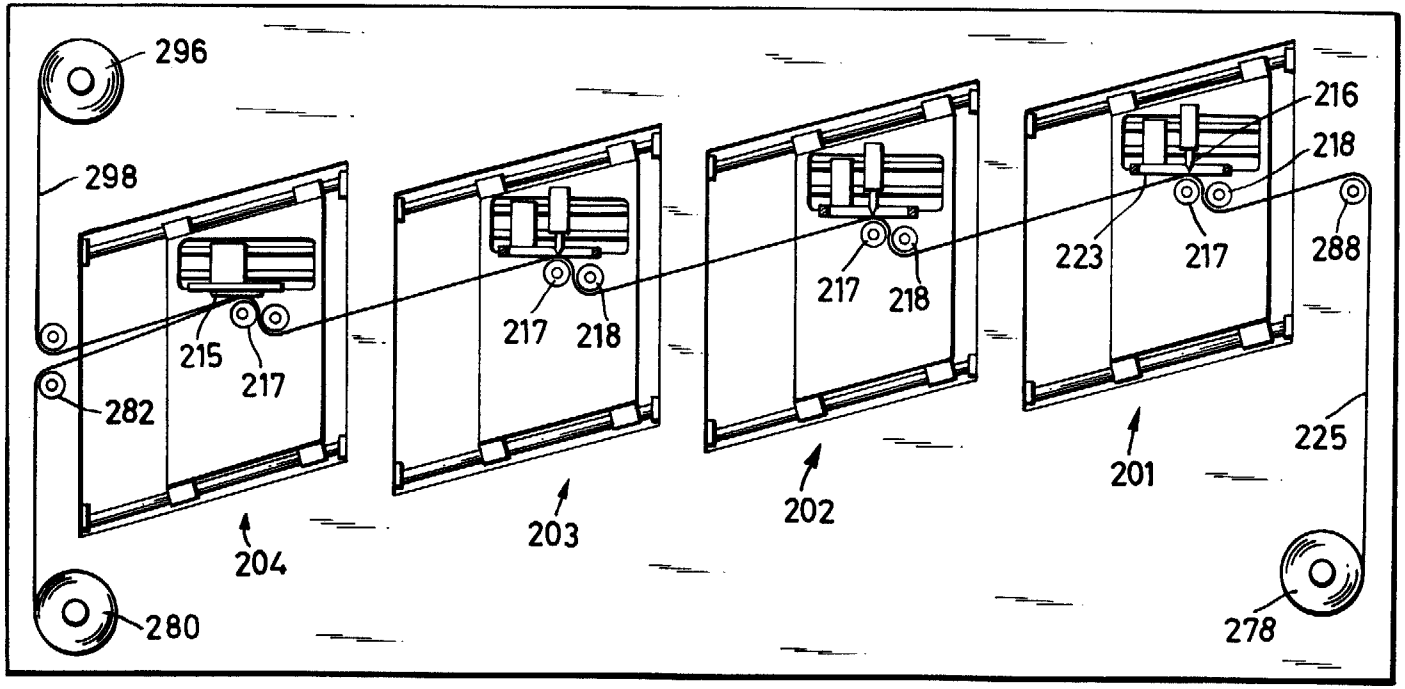
FIG. 13 shows a diagrammatic front view of a multistation printing machine with a punching or stamping apparatus.

Reference will now be made to FIG. 13 which shows a screen printing machine having three printing stations 201, 202 and 203 and a station 204 in which the labels or tickets are punched or stamped out, using an apparatus as shown in FIGS. 1 through 6. The web 225 to be processed is drawn from a supply roll 278 and is passed through the three printing stations 201 through 203 and thereafter through the punching or stamping station 204, in a continuous movement. The carrier layer of the double-layer web 225 is wound on to a receiving roll 294, after the operation of cutting out the labels or tickets. The web portion 298 which remains after the labels or tickets have been cut out from the web is rolled on a storage roll 296.

The machine shown in FIG. 13 makes it possible to apply three print agents such as links or dyes, or other coating materials. The individual printing stations are constructed in the manner described with reference to FIGS. 1 and 2, with the difference that a screen printing stencil is provided in place of the punching or stamping blade, and that there is additionally a doctor 216. The construction is the same, with regard to the support or abutment roller 217 and the web guide roller 218, so that the individual components of all the stations, that is to say, the screen printing stencils 223 or blade 215 on the one hand and the abutment or support rollers 217 and the web guide rollers 218 and, in the printing stations, the doctors 216, can be moved synchronously with each other, although this is not necessarily the case. On the contrary, it is for example possible to carry out a printing stroke movement in the printing stations 201 through 203, during which printing stroke movement two labels or tickets are printed, while two punching or stamping stroke movements are carried out in the cutting station 204, in the same period of time, in order to cut out the labels or tickets; the sum of the length of the two cutting stroke movements in the station 204 must be equal to the length of the printing stroke movement in the other stations. Other combinations of this kind are also possible. The speed of the web is the same in all the stations.

The support or abutment rollers 217 and the web guide rollers 218 in all the stations, the guide rollers 282 and 288, and possibly other rollers which are disposed between the stations but which are not shown in the drawings, are advantageously driven by a common drive means in such a way that the flexible transmission member 86 shown in FIG. 3 engages with all the gear wheels or the like which are associated with the rollers 217 and 218 in the printing stations 201 through 203 and the cutting station 204, and also with the gear wheels of the abovementioned guide rollers which are disposed between the respective stations. In this respect, it should be noted that the flexible transmission member extends parallel to the web 225 in the regions in which the rollers 217 and rollers 218 of all the stations are moved, as was described above with reference to FIG. 3. However, it is also possible for a separate flexible transmission member, similar to the member 86 in FIG. 3, to be associated with each station.

In a modification of the arrangement shown in FIG. 13, the cutting station 204 could also be disposed upstream of the first printing station 201 so that the material in web form to be printed comprises a carrier web to which individual cut-out portions which are to be printed are secured.

The invention is in no way limited to the use of webs comprising two layers of material. On the contrary, it can be used anywhere where portions are to be stamped or punched out of uniformly moving webs, irrespective of the manner in which the punched-out or stamped-out portions are processed or fed on, after the stamping or punching operation.

We claim:

1. A process for punch cutting portions from a web which is moved uniformly in its longitudinal direction between a blade and a co-operating support member, wherein the blade is brought into engagement with the web, the blade is displaced from a starting position during the cutting operation in the direction of movement of the web synchronously therewith, over a distance which is less than the length of the portion to be cut out, and the blade is disengaged from the web and returned to its starting position.

2. A process as set forth in claim 1 wherein the support member comprises at least one roller which is displaced during the cutting operation in the opposite direction to the movement of the blade.

3. A process as set forth in claim 1 wherein the blade on engaging the web initially forms a plurality of partial cuts in the web, and said cuts are completed by the cutting stroke movement of the blade to form the complete cut.

4. A process as set forth in claim 2 wherein the web is moved approximately tangentially past said at least one support roller.

5. A process as set forth in claim 3 wherein the support member is a roller and the web is passed around part of the periphery of the roller and is rolled against the blade, with the web interposed, during the cutting stroke movement thereof.

6. A process as set forth in claim 5 wherein the web section is fed to the cutting mechanism comprising at least the blade and a displaceable support roller along a first substantially rectilinear path and the web leaves said cutting mechanism along a second substantially rectilinear path, wherein said first and second paths extend substantially parallel to each other at least in the region within which the support roller is displaced during the cutting stroke movement of the blade, wherein said first and second paths extend downwardly at an acute angle to the blade which is disposed substantially horizontally and wherein said cutting mechanism is moved substantially parallel to said first and second paths at least during the cutting stroke movement of the blade.

* * * * *